US007791558B2

(12) United States Patent
Su et al.

(10) Patent No.: US 7,791,558 B2
(45) Date of Patent: Sep. 7, 2010

(54) SELF-SECURED ANTENNA DEVICE

(75) Inventors: Kuo-Ying Su, Taipei (TW); Yung-Da Lin, Taipei (TW)

(73) Assignee: Avermedia Technologies, Inc., Taipei (TW)

( * ) Notice: Subject to any disclaimer, the term of this patent is extended or adjusted under 35 U.S.C. 154(b) by 169 days.

(21) Appl. No.: 12/140,749

(22) Filed: Jun. 17, 2008

(65) Prior Publication Data

US 2009/0174619 A1 Jul. 9, 2009

(30) Foreign Application Priority Data

Jan. 8, 2008 (TW) ..... 97200442 U

(51) Int. Cl.
*H01Q 1/12* (2006.01)

(52) U.S. Cl. ..... 343/878; 343/702

(58) Field of Classification Search ..... 343/757, 343/702, 878, 882

See application file for complete search history.

(56) References Cited

U.S. PATENT DOCUMENTS 5,734,356 A * 3/1998 Chang ..... 343/882
6,067,057 A * 5/2000 Yajima et al. ..... 343/878
7,236,140 B2 * 6/2007 Vainer ..... 343/878

* cited by examiner

*Primary Examiner*—Tan Ho
(74) *Attorney, Agent, or Firm*—Kirton & McConkie; Evan R. Witt

(57) ABSTRACT

An antenna device for use with a wireless signal processing interface includes a main body; an antenna module received by the main body and having a first signal-receiving bar and a second signal-receiving bar pivotally protruding from a first surface and a second surface of the main body, respectively; and a securing member having a first portion coupled to the main body and a second portion to be detachably coupled to a supporting object. The securing member is made of an elastic material and distorted when coupled to the supporting object so as to provide a securing force to fix the antenna device onto the supporting object.

19 Claims, 10 Drawing Sheets

SELF-SECURED ANTENNA DEVICE

FIELD OF THE INVENTION

The present invention relates to an antenna device, and more particularly to an antenna device for use with a wireless signal processing interface. The antenna device has a securing member capable of securing the antenna device itself onto a receiving plane or object.

BACKGROUND OF THE INVENTION

For watching TV programs on a computer display, a signal processing interface such as a TV box or a TV tuner card is coupled to the computer system for receiving and converting cable-transmitted or broadcast TV signals into a format suitable to be displayed by the computer system.

With the improvement of mobile computing technologies, portable electronic devices with advanced mobile computing functions are created and developed. Examples include laptop computers, personal digital assistants (PDA), small-size liquid crystal displays (LCD), and so on. These electronic devices play more and more important roles in our daily lives because they provide a variety of utilities to people and change our ways of lives. Taking the application of a computer to TV program watching as an example, it is very convenient for people outdoors to watch wirelessly transmitted TV programs as long as a notebook computer with a built-in or plugged-in TV tuner card is available. Generally, the TV tuner card receives TV signals transmitted in a radio-frequency (RF) form via an antenna, and then converts the TV signals into a format suitable to be displayed by the computer.

Please refer to FIG. 1A, which schematically shows a notebook computer 10 equipped with a TV tuner card 12. The TV tuner card 12 is typically a cardbus-type or ExpressCard-type interface card. It can also be a TV interface card with USB expanded functions. The TV tuner card 12 is combined with the notebook computer 10 by way of a transmission interface 11, and provides the expanded function for the notebook computer 10. As shown in the figure, the TV tuner card 12 is mounted to the transmission interface 11, and is further coupled to an antenna 13 for receiving therefrom the TV signals.

Since the antenna 13 is for use with the TV tuner card 12, it is preferable that the antenna 13 is disposed near the notebook computer 10 carrying the TV tuner card 12. Furthermore, the antenna 13 is generally extensible and retractable by being exerted with a pulling or pressing force on the tip 131 thereof. In addition to the length, the angle of the antenna 13 is generally adjustable in order to receive TV signals with a better quality. However, the elongated and/or tilted antenna 13 is subject to fall due to lost center of gravity. The situation becomes worse when the object supporting the notebook computer 10 as well as the antenna is shaky.

For solving the unstable problem of the antenna 13, a securing base 130 having a relatively large area can be mounted under the antenna 13, as illustrated in FIG. 1B. Conventionally, the antenna 13 is fixed onto the securing base 130 by way of a magnetic force, but the securing base 130 is just placed on a plane of the supporting object without any connection. Then, when it is necessary to pull or pivot the antenna 13 for adjusting signal intensity, as shown in FIG. 1C, the securing base 130 is likely not stable enough for easy operation with one hand. On the other hand, if the securing base 130 is fixed onto the supporting object to improve stability, the mobility of the antenna 13 together with the notebook computer 10 will be adversely affected.

SUMMARY OF THE INVENTION

Therefore, the present invention provides a self-secured antenna device which has advantages of good mobility and high securing capability.

The present invention provides an antenna device for use with a wireless signal processing interface, e.g. a TV tuner card, which includes a main body; an antenna protruding from the main body; and a securing member having a first portion coupled to the main body and a second portion to be detachably coupled to a supporting object; wherein the securing member is made of an elastic material and distorted when coupled to the supporting object so as to provide a securing force to fix the antenna device onto the supporting object.

In an embodiment, the main body includes a box portion and a base portion which are integrally formed or connected via a shaft. By the shaft, the box portion is pivotal relative to the base portion, thereby adjusting the orientation of the antenna.

In an embodiment, the antenna includes a first signal-receiving bar and a second signal-receiving bar extensible and retractable segmentally to take advantage of a dipole effect. By providing a first stopper and a second stopper next to the first signal-receiving bar and a second signal-receiving bar, the pivoting levels of the first signal-receiving bar and a second signal-receiving bar can be confined.

In an embodiment, the securing member includes: an upper T-post engageable with the base portion by entering an elongated opening of the base portion and then turning a certain angle; and a lower suction-disk portion optionally distorted to provide a suction force as the securing force when compressed onto the supporting object.

In another embodiment, the securing member includes: an upper T-post engageable with the base portion by entering an elongated opening of the base portion and then turning a certain angle; and a lower clamping portion made of an elastic material and having two downwardly extending plates optionally distorted to provide a clamping force as the securing force when engaged with the supporting object.

In an embodiment, the securing member further includes two buffer pads on oppositely facing surfaces of the plates for providing a buffer effect to protect the supporting object from scratching and providing a frictional force to secure the coupling of the antenna device to the supporting object.

In another aspect, the present invention provides an antenna device for use with a wireless signal processing interface, which includes: a main body; an antenna module received by the main body and having a first signal-receiving bar and a second signal-receiving bar pivotally protruding from a first surface and a second surface of the main body, respectively; and a securing member having a first portion coupled to the main body and a second portion to be detachably coupled to a supporting object; wherein the securing member is made of an elastic material and distorted when coupled to the supporting object so as to provide a securing force to fix the antenna device onto the supporting object.

In a further aspect, the present invention provides an antenna device for use with a wireless signal processing interface, which includes: a main body having an elongated opening on a surface thereof; an antenna protruding from the main body; a first securing member; and a second securing member. The first securing member includes a T-post engageable with the main body by entering the elongated opening of the main body and then turning a certain angle; and a suction-disk portion optionally distorted to provide a suction force to secure the antenna device onto a first type of supporting object when compressed onto the supporting object. The second securing member includes a T-post engageable with the main body by entering the elongated opening of the main body and then turning a certain angle; and a clamping portion having two downwardly extending plates optionally distorted to provide a clamping force to secure the antenna device onto a second type of supporting object when engaged with the supporting object. The first securing member and the second securing member are replaceable to engage with the main body depending on the type of the supporting object.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

Figure 1A:
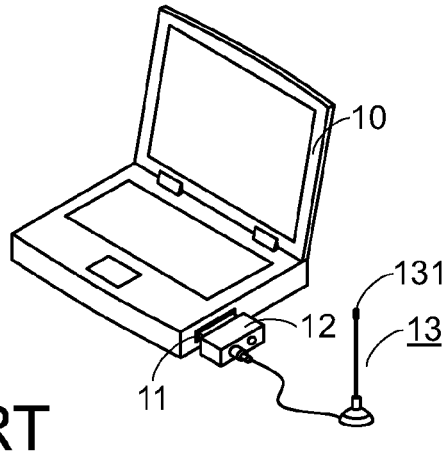
FIG.1A PRIOR ART
FIG. 1A~FIG. 1C are schematic diagrams illustrating a conventional antenna device used with a TV tuner card to play a TV program on a notebook computer.
Figure 1B:
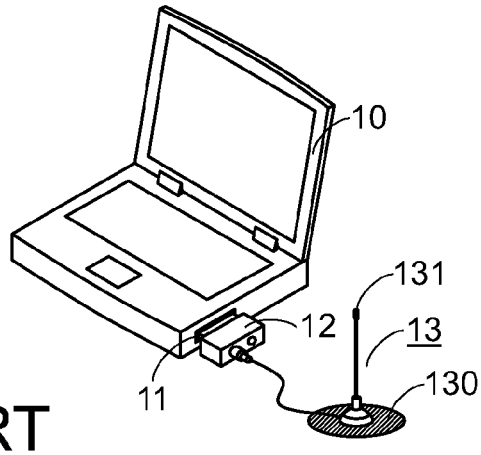
FIG.1B PRIOR ART
Figure 1C:
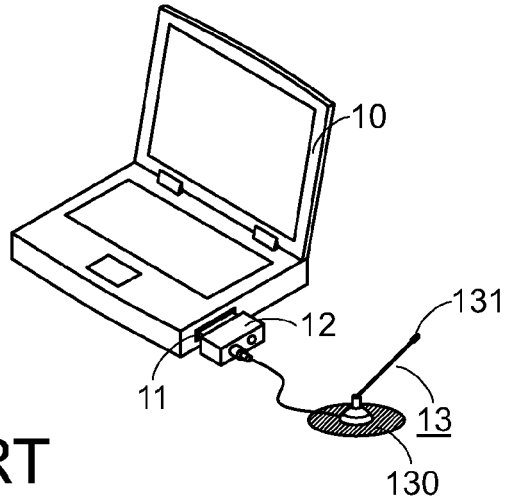
FIG.1C PRIOR ART
Figure 2A:
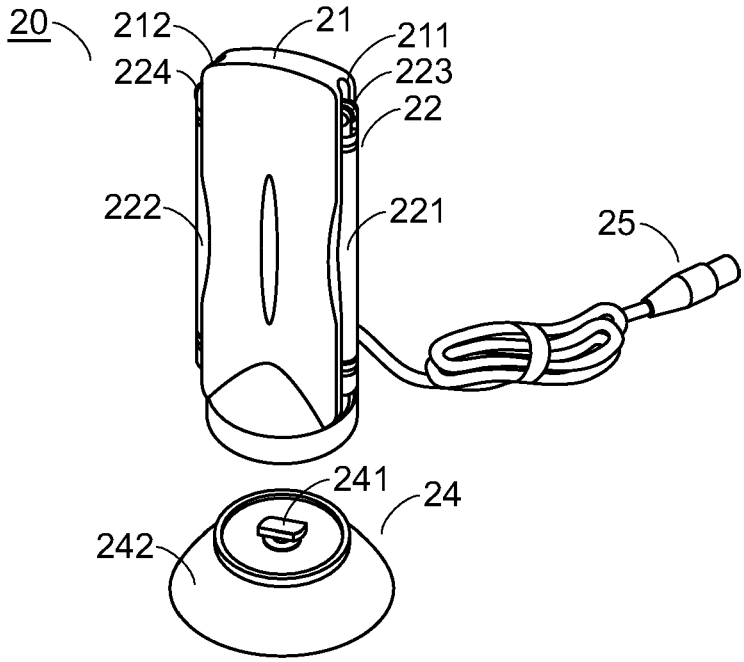
FIG. 2A is schematic diagram illustrating an antenna device according to an embodiment of the present invention, wherein the antenna is in a closed state.
Figure 2B:
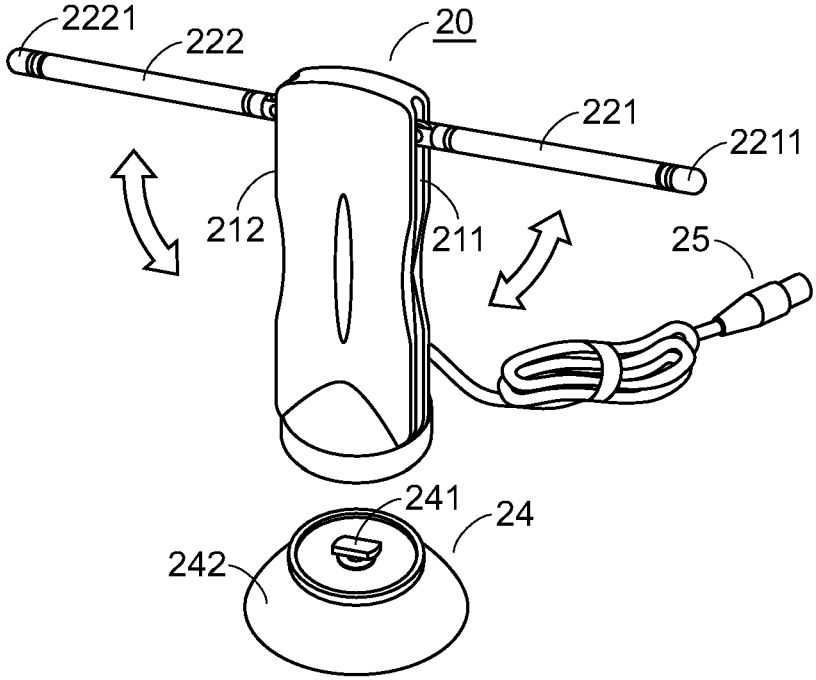
FIG. 2B is schematic diagram illustrating the antenna device of FIG. 2A, wherein the antenna is in an open state.

Please refer to FIGS. 2A and 2B, which illustrate an antenna device to be used with a wireless signal processing interface such as a TV tuner card according to an embodiment of the present invention. The antenna device 20 includes a main body 21 in communication with the wireless signal processing interface, an antenna module 22 extending from the main body 21 for receiving wireless signals required by the wireless signal processing interface, and a securing member 24 connected to the main body 21 for securing the antenna device 20 onto a supporting object (not shown). In this embodiment, the securing member 24 is detachably combined to the main body 21 as shown.

In this embodiment, the main body 21 is substantially shaped as a flat box integrally formed with a cone base, and has a hollow portion for accommodating a circuit board (not shown) to be connected to the wireless signal processing interface via a signal output cable 25. The antenna module 22 includes two extensible and retractable signal-receiving bars 221 and 222. The signal-receiving bars 221 and 222 are coupled to and pivotal to respective hinges 223 and 224, as indicated by the arrows, which are disposed at opposite sides 211 and 212 of the main body 21 and electrically connected to the circuit board inside the main body 21. FIG. 2A illustrates a closed state of the signal-receiving bars 221 and 222 while FIG. 2B illustrates an open state of the signal-receiving bars 221 and 222. The signal-receiving bars 221 and 222 further have extensible and retractable free ends 2221 and 2222 which can be pulled outwards with selective levels to extend the signal-receiving bars 221 and 222 segmentally, if necessary, for better signal quality.

The received signals are received from the signal-receiving bars 221 and 222, processed by the circuit board inside the main body 21, and then transmitted to the wireless signal processing interface via the cable 25. The electronic circuitry and principle for receiving, processing and transmitting wireless signals are known to those ordinary in the art, and would not be redundantly described herein. However, the use of two oppositely arranged signal-receiving bars is advantageous not only in better signal-receiving performance due to the dipole feature but also in better balance of the entire antenna device.

Figure 3A:
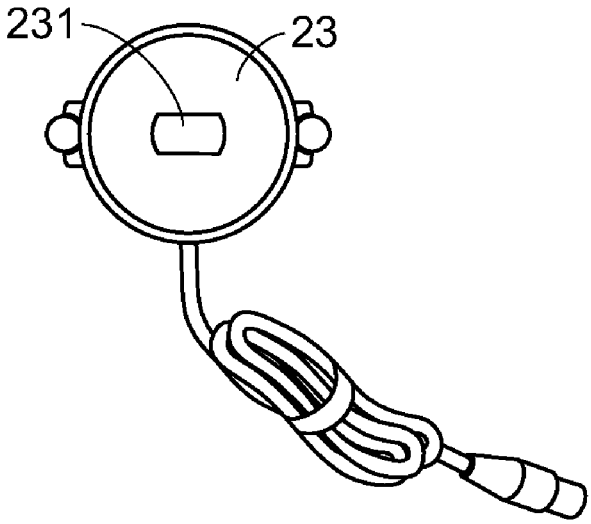
FIG. 3A and FIG. 3B are schematic diagram illustrating means for assembling the antenna device of FIG. 2.
Figure 3B:
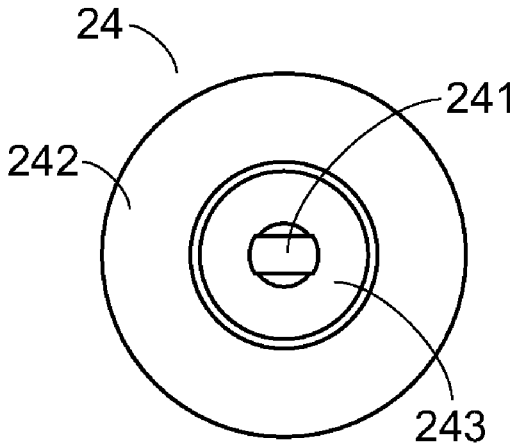
Figure 4C:
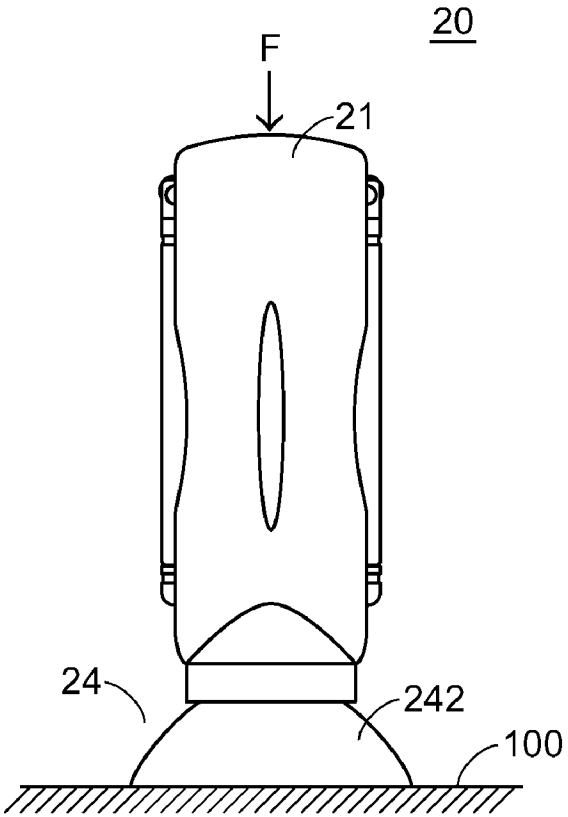
FIG. 4A~FIG. 4C are schematic diagram illustrating the assembling operation of the antenna device of FIG. 2 and the coupling of the antenna device to a supporting object.
Figure 4B:
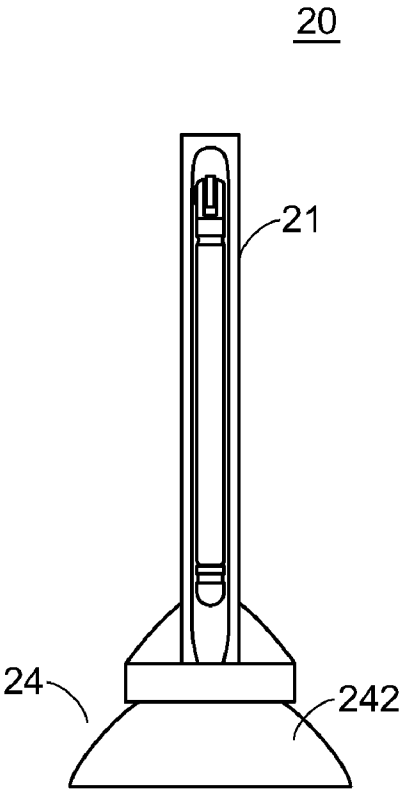
Figure 4A:
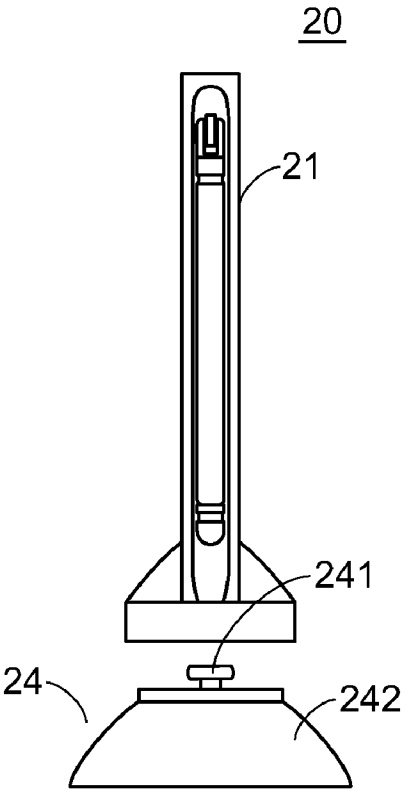

Furthermore, for combining the securing member 24 with the main body 21, an engagement structure is provided. For example, the engagement of the securing member 24 with the main body 21 can be implemented with an elongated opening 231 created in the bottom 23 of the cone base and a T-post 241 protruding from the top 243 of the securing member 24, as shown in FIGS. 3A and 3B. Alternatively, the securing member can be provided with a concave structure to be engaged with a convex structure provided on the cone base. The length of the opening 231 is a little larger than the head portion of the T-post 241 so as to be able to receive the T-post 241, and the shape of the opening 231 allows the T-post 241 turning thereinside by an angle to sustain against the bottom 23 of the cone base from inside so as to be stuck in the opening 231. The securing member 24 can be detached from the main body 21 in a reversed way. FIG. 4A~FIG. 4C illustrate the combination of the securing member 24 with the main body 21 in the above-described manner wherein the turning angle is substantially 90 degrees.

The securing member 24, in addition to the T-post portion 241, includes a skirt portion 242 which is a suction-disk structure. After the engagement of the securing member 24 with the main body 21, the combined antenna device can be fixed onto a supporting object 100 (FIG. 4C) by exerting a vertically downward compressing force F to have the suction-disk structure 242 distorted. The distortion of skirt portion 242 forces air out of the space inside the skirt portion 242 so as to secure the antenna device onto the supporting object 100 with external air pressure.

Figure 5A:
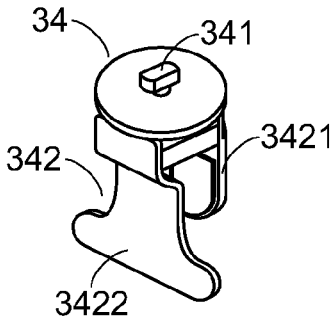
FIG. 5A~FIG. 5D are schematic diagrams illustrating a securing member of an antenna device according to another embodiment of the present invention.
Figure 5B:
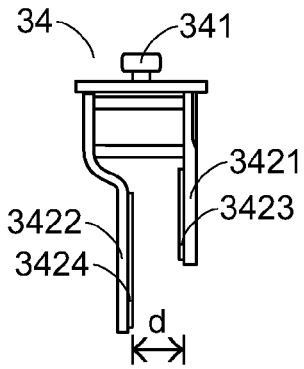

It is understood that the suction-disk type securing member is adapted to a smooth plane. Herein, another embodiment of the present invention provides an antenna device which is applicable to a situation that there is no suitable plane for securing the suction disk, in spite it can also be used in a situation that there is a smooth plane. The main body and antenna module in this embodiment are similar to those shown and described hereinbefore. The securing member, on the other hand, is illustrated in FIG. 5A~FIG. 5D. The securing member 34 includes a T-post 341 on the top as a part of the engagement structure with the cone base of the main body, and a clamping structure 342 to be fixed onto a supporting plane. The clamping structure 342 includes a first plate 3421 and a second plate 3422, which are made of elastic material and extend downwards, as shown in FIG. 5A and FIG. 5B. On the oppositely facing surfaces of the plates 3421 and 3422, buffer pads 3423 and 3424, for example made of foam, are adhered. The clamping structure provides a clearance d between the plates 3421 and 3422 so that the antenna device with the main body and the securing member 34 combined together, as shown in FIG. 6A~FIG. 6C, can be secured onto a supporting object having a thickness around "d". Due to elastic feature of the plates 3421 and 3422 and the frictional feature of the buffer pads 3423 and 3424, the thickness of the supporting object is allowed to have a larger tolerance deviating from the thickness "d" without adversely affecting the fixing capability. The clearance d between the plates 3421 and 3422 is designed depending on the practical uses of the antenna device. The buffer pads 3423 and 3424 further protect the supporting object from being scratched by the securing member 34.

Figure 5C:
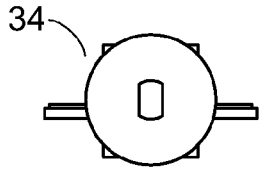
Figure 5D:
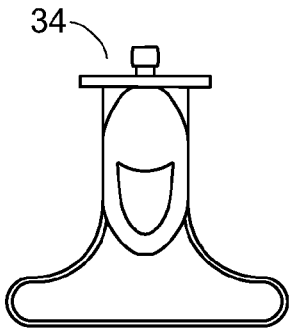
Figure 6A:
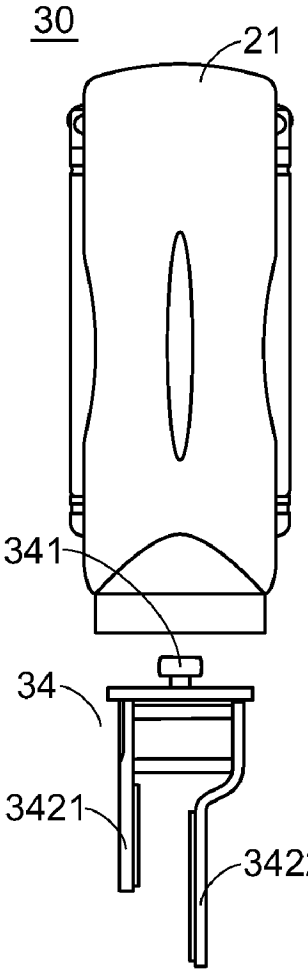
FIG. 6A~FIG. 6C are schematic diagram illustrating the assembling operation of the antenna device of FIG. 5.
Figure 6B:
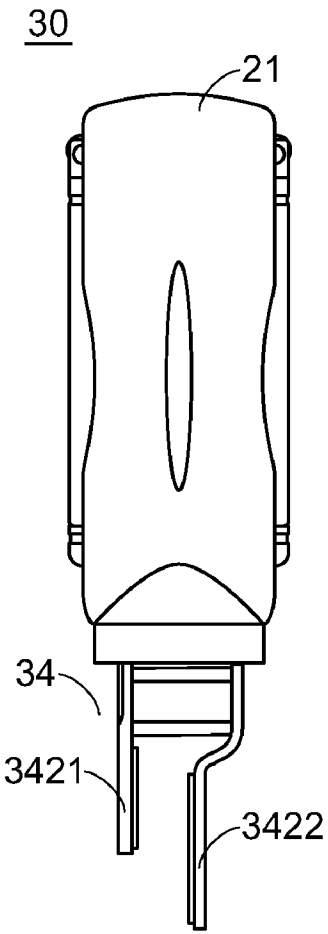
Figure 6C:
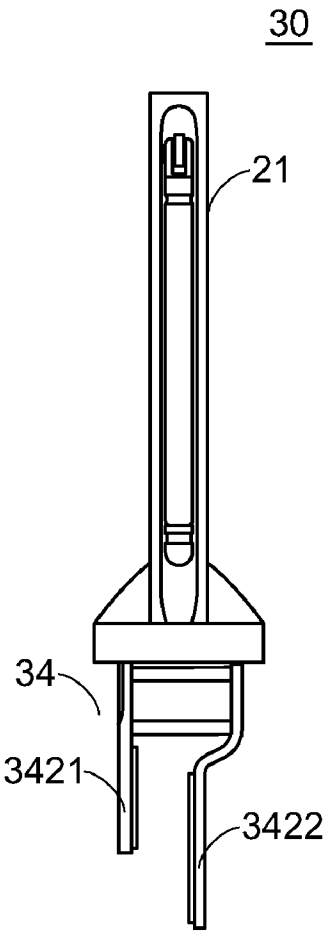
Figure 7:
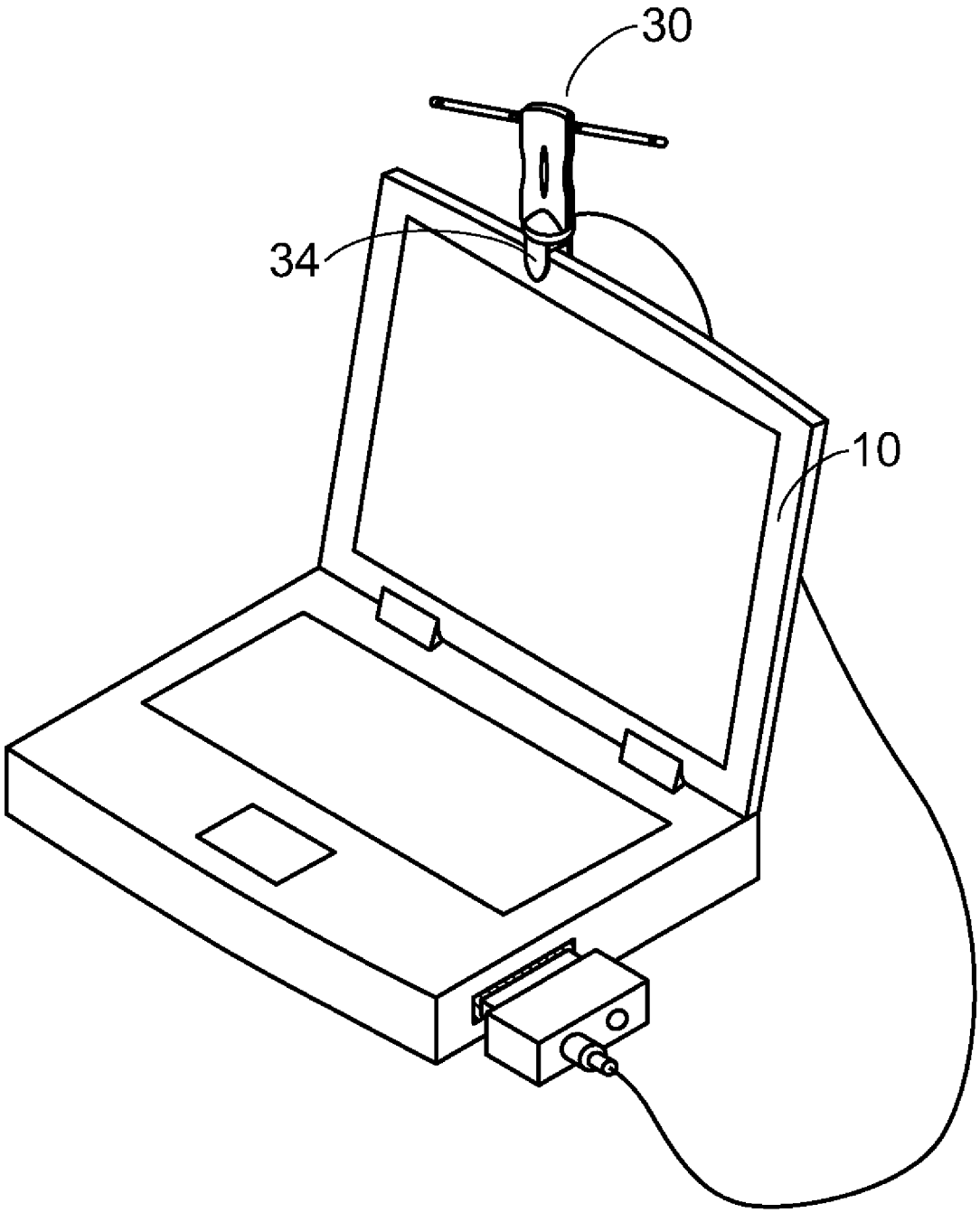
FIG. 7 is a schematic diagram illustrating the coupling of the antenna device of FIG. 5 to a notebook computer.

As shown in the top view of FIG. 5C and the side view of FIG. 5D, it can be seen that the second plate 3422 is designed with larger length and width. The enlarged plate 3422 provides a better back-supporting when the antenna device 30 is secured onto a supporting object, e.g. a display housing of a notebook computer 10, as shown in FIG. 7.

In the above embodiments, the securing member is detachable from the main body so that different kinds of securing members can be selectively used with the main body depending on the structure of the supporting object. For example, a suction-disk structure is adapted to a supporting object having a smooth plane, while a clamping structure is adapted to a supporting object having a matching thickness of housing. Alternatively, the securing member can be integrally formed with the main body although it would be less flexible in use compared to the detachable ones.

Figure 8A:
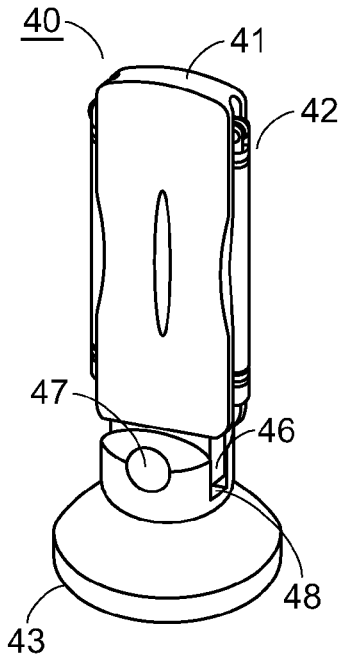
FIG. 8A~FIG. 8B are schematic diagrams illustrating an antenna device according to a further embodiment of the present invention.
Figure 8B:
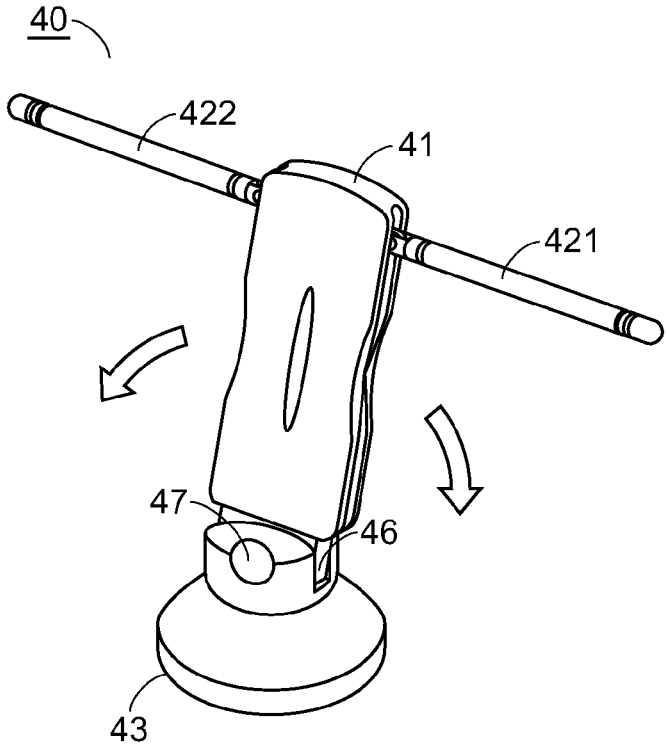

FIGS. 8A and 8B illustrate a third embodiment of antenna device according to the present invention. In this embodiment, the above-mentioned box portion and cone base of the main body 21 are separate members which are linked by a shaft 47. The box portion 41 of the antenna device 40 has an extending member 46 and the cone base 43 has a trench 48 for receiving the extending member 46. There are through holes (not shown) created in both of the extending member 46 and the cone base 43 and aligned with each other for the shaft 47 to penetrate through. About the shaft, the extending member 46 is pivotal to adjust an angle of the antenna device 40 relative to the supporting object, as indicated by the arrows of FIG. 8B. The angle adjustment is sometimes required for better signal-tuning performance of the signal-receiving bars 421 and 422.

Figure 9A:
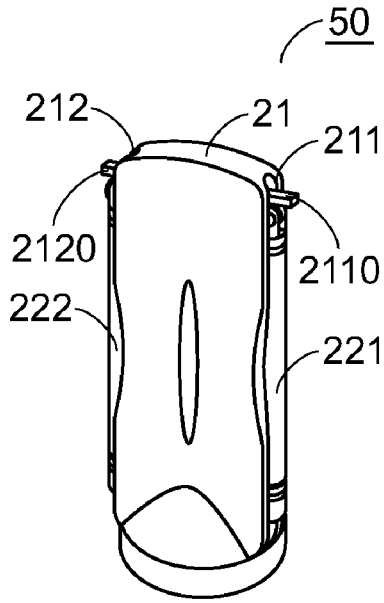
FIG. 9A~FIG. 9B are schematic diagrams illustrating a main body of an antenna device according to a yet another embodiment of the present invention.
Figure 9B:
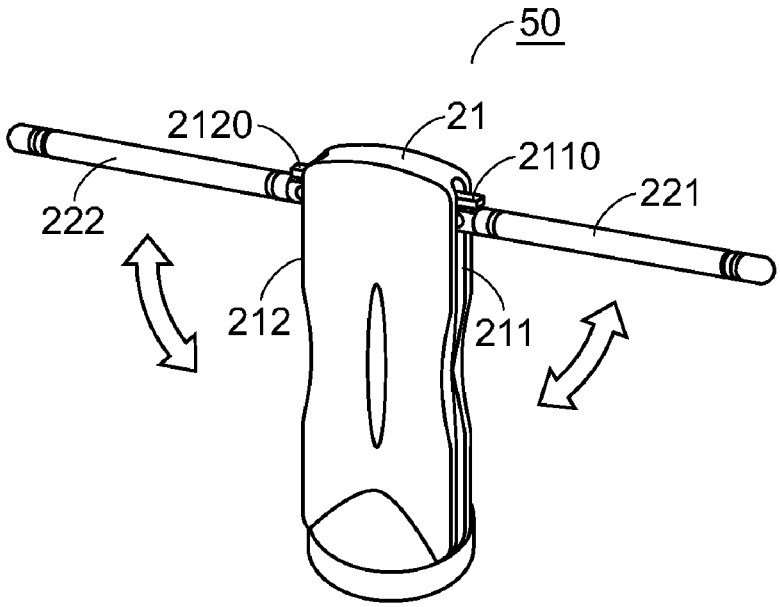
Figure 10A:
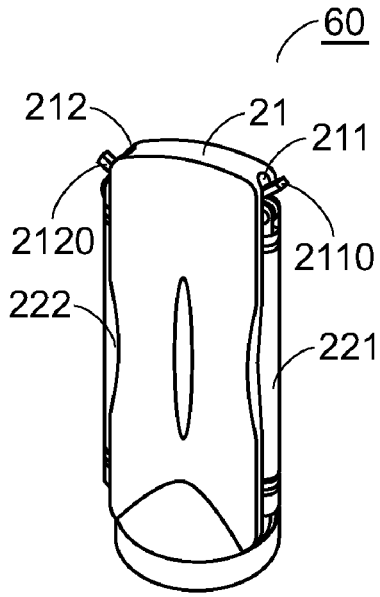
FIG. 10A~FIG. 10B are schematic diagrams illustrating a main body of an antenna device according to a yet further embodiment of the present invention.
Figure 10B:
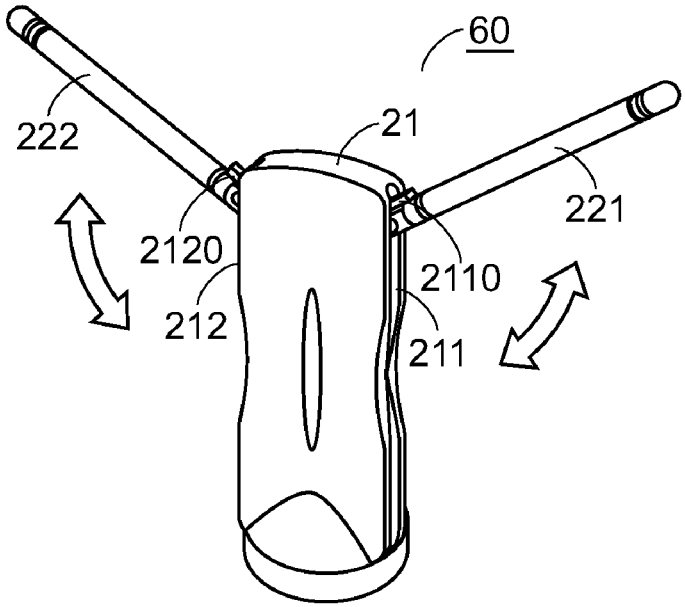

Generally, the signal-receiving bars presented as horizontally raised arms have best dipole performance. Therefore, it is preferred to readily keep the signal-receiving bars in the horizontal state. Nevertheless, a specified angle other than 180 degrees between bars may be optimal in some specific cases. Then it is preferred to readily keep the signal-receiving bars at the specified angle. Further embodiments of antenna devices 50 and 60 according to the present invention, as shown in FIGS. 9A~9B and FIGS. 10A~10B, provide stopper pins 2110 and 2120 at opposite sides 211 and 212 of the main body 21. When the signal-receiving bars 221 and 222 pivots to sustain against the stopper pins 2110 and 2120, they cannot go further so as to be fixed in a desired configuration. FIGS. 9A~9B illustrate the case that the desired angle between the signal-receiving bars 221 and 222 is substantially 180 degrees; and FIGS. 10A~10B illustrate the case that the desired angle between the signal-receiving bars 221 and 222 is less than 180 degrees, i.e. each of the signal-receiving bars 221 and 222 is pivoted more than 90 degrees.

It is understood from the above descriptions that the present antenna device can be secured onto a supporting object, not limited to a smooth plane, in an easy way. By providing two antenna bars, an advantageous dipole effect can be achieved. By allowing the main body pivotal relative to the supporting object, the orientation of the antenna can be adjusted to exhibit better signal quality.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna device for use with a wireless signal processing interface, comprising:

a main body;

an antenna protruding from the main body; and a securing member having a first portion coupled to the main body and a second portion to be detachably coupled to a supporting object;

wherein the main body includes:

a box portion mounted thereon the antenna, and having a hollow space for accommodating circuitry for processing a signal received from the antenna; and a base portion disposed between the box portion and the securing member and providing an exit for a cable to connect the circuitry to the wireless signal processing interface, and wherein the securing member is made of an elastic material and distorted when coupled to the supporting object so as to provide a securing force to fix the antenna device onto the supporting object.

2. The antenna device according to claim 1 wherein the box portion and the base portion are integrally formed.

3. The antenna device according to claim 1 wherein the box portion and the base portion are coupled to each other via a shaft penetrating therethrough so that the box portion is pivotal about the base portion to adjust orientation of the antenna.

4. The antenna device according to claim 3 wherein the base portion has an upper trench and the box portion has a lower extending member pivotally engageable with the upper trench, and the trench and the extending member have corresponding through holes aligned with each other for penetrating therethrough the shaft.

5. The antenna device according to claim 1 wherein the antenna includes a first signal-receiving bar and a second signal-receiving bar, the main body further includes a first hinge and a second hinge disposed on a first surface and a second surface opposite to the first surface, respectively, and via the first hinge and the second hinge, the first signal-receiving bar and the second signal-receiving bar are coupled to and pivotal about the main body.

6. The antenna device according to claim 5 wherein the main body further includes a first stopper and a second stopper disposed on the first surface and the second surface, respectively, which stop the first signal-receiving bar and the second signal-receiving bar from further pivoting so as to confine the first signal-receiving bar and the second signal-receiving bar at fixed positions.

7. The antenna device according to claim 6 wherein the first stopper and the second stopper are pin-shaped and protrude from the first surface and the second surface, respectively.

8. The antenna device according to claim 5 wherein the first signal-receiving bar and the second signal-receiving bar are extensible and retractable segmentally.

9. The antenna device according to claim 1 wherein the first portion of the securing member is detachably mounted onto a base portion of the main body.

10. The antenna device according to claim 9 wherein the securing member includes:

an upper T-post engageable with the base portion by entering an elongated opening of the base portion and then turning a certain angle; and a lower suction-disk portion optionally distorted to provide a suction force as the securing force when compressed onto the supporting object.

11. The antenna device according to claim 9 wherein the securing member includes:

an upper T-post engageable with the base portion by entering an elongated opening of the base portion and then turning a certain angle; and a lower clamping portion made of an elastic material and having two downwardly extending plates optionally distorted to provide a clamping force as the securing force when engaged with the supporting object.

12. The antenna device according to claim 11 wherein the securing member further includes two buffer pads on oppositely facing surfaces of the plates for providing a buffer effect to protect the supporting object from scratching and providing a frictional force to secure the coupling of the antenna device to the supporting object.

13. The antenna device according to claim 1 for use with a TV tuner card.

14. An antenna device for use with a wireless signal processing interface, comprising:

a main body;

an antenna module received by the main body and having a first signal-receiving bar and a second signal-receiving bar pivotally protruding from a first surface and a second surface of the main body, respectively; and a securing member having a first portion coupled to the main body and a second portion to be detachably coupled to a supporting object;

wherein the securing member is made of an elastic material and distorted when coupled to the supporting object so as to provide a securing force to fix the antenna device onto the supporting object.

15. The antenna device according to claim 14 wherein the main body further includes a first stopper pin and a second stopper pin protruding from the first surface and the second surface at specified angles, respectively, and the stopper pins stop the first signal-receiving bar and the second signal-receiving bar from further pivoting so as to confine the first signal-receiving bar and the second signal-receiving bar at fixed positions.

16. The antenna device according to claim 14 wherein the securing member includes:

a T-post engageable with the main body by entering an elongated opening of the main body and then turning a certain angle; and a suction-disk portion optionally distorted to provide a suction force as the securing force when compressed onto the supporting object.

17. The antenna device according to claim 14 wherein the securing member includes:

a T-post engageable with the base portion by entering an elongated opening of the main body and then turning a certain angle; and a clamping portion having two downwardly extending plates optionally distorted to provide a clamping force as the securing force when engaged with the supporting object.

18. The antenna device according to claim 17 wherein the securing member further includes two buffer pads on oppositely facing surfaces of the plates for providing a buffer effect to protect the supporting object from scratching and providing a frictional force to secure the coupling of the antenna device to the supporting object.

19. An antenna assembly for use with a wireless signal processing interface, comprises:

a main body having an elongated opening on a surface thereof;

an antenna protruding from the main body;

a first securing member including:

a T-post engageable with the main body by entering the elongated opening of the main body and then turning a certain angle; and a suction-disk portion optionally distorted to provide a suction force to secure the antenna device onto a first type of supporting object when compressed onto the supporting object; and a second securing member including:

a T-post engageable with the main body by entering the elongated opening of the main body and then turning a certain angle; and a clamping portion having two downwardly extending plates optionally distorted to provide a clamping force to secure the antenna device onto a second type of supporting object when engaged with the supporting object;

wherein the first securing member and the second securing member are replaceable to engage with the main body depending on the type of the supporting object.

* * * * *